US006050119A

United States Patent [19]

Potts

[11] Patent Number: 6,050,119

[45] Date of Patent: Apr. 18, 2000

[54] UNIVERSAL KEY RING ASSEMBLY

[76] Inventor: Fran Potts, 4631 Fitzgerald, Youngstown, Ohio 44515

[21] Appl. No.: 09/236,752

[22] Filed: Jan. 25, 1999

[51] Int. Cl.[7] ..... A44B 15/00

[52] U.S. Cl. ..... 70/456 R; 63/1.18; 63/3; 70/457

[58] Field of Search ..... 70/456 R, 457, 70/458, 459, 456 B; 63/3, 23, 1.11, 1.12, 1.18; 40/633

[56] References Cited

U.S. PATENT DOCUMENTS

| | | | |
|---|---|---|---|
| D. 315,056 | 3/1991 | Seitz . | |
| D. 322,720 | 12/1991 | Moore . | |
| D. 335,217 | 5/1993 | Seitz . | |
| 2,561,894 | 7/1951 | Wallich | 40/633 |
| 2,728,501 | 12/1955 | Hill | 70/456 R |
| 3,124,286 | 3/1964 | Dompier . | |
| 3,153,869 | 10/1964 | Twentier | 40/633 |
| 3,604,232 | 9/1971 | Mosher | 70/457 |
| 3,656,247 | 4/1972 | Bushnell et al. | 40/633 |
| 4,037,442 | 7/1977 | Staude et al. | 70/456 R |
| 4,121,360 | 10/1978 | Vlerebome | 63/1.11 |
| 4,179,833 | 12/1979 | Knodel | 40/633 |
| 4,239,136 | 12/1980 | Godwin | 70/458 |
| 4,760,715 | 8/1988 | Ramos, Jr. | 63/3 |
| 5,279,057 | 1/1994 | Melin et al. | 40/633 |
| 5,312,159 | 5/1994 | Essa et al. | 297/482 |

FOREIGN PATENT DOCUMENTS

| | | | |
|---|---|---|---|
| 1272021 | 7/1990 | Canada | 63/3 |
| 489981 | 6/1992 | European Pat. Off. | 63/3 |
| 2228915 | 9/1990 | United Kingdom | 40/633 |
| 2243986 | 11/1991 | United Kingdom | 70/456 R |

*Primary Examiner*—Darnell M. Boucher
*Attorney, Agent, or Firm*—Harpman & Harpman

[57] ABSTRACT

A universal key ring assembly having an attachment band of thin flat material with a self-adhesive on its inner engagement surface. An engagement loop is secured to the adhesive surface on the attachment band and extends therefrom defining a central engagement point for key ring elements. The attachment band is secured about any shaped element that then becomes the key ring base of support.

7 Claims, 4 Drawing Sheets

UNIVERSAL KEY RING ASSEMBLY

BACKGROUND OF THE INVENTION

1. Technical Field

This invention relates to key rings and attachment devices in general wherein a non-specific element becomes a support structure from which keys or other elements can be held for ease of access and location.

2. Description of Prior Art

Prior art devices of this type are typically defined by key ring engagement and holding configurations wherein a split metal ring having a central opening therein or a spiral overlapping open engageable ends extend from a central element. Such key ring elements can be a variety of utilitarian or symbolic elements such as remote control transmitters for access to cars. Symbolic elements can be any variety of small objects such as name tags, or commercial representations for advertising and the like. Adaptable key rings of a bracelet nature can be seen in U.S. Pat. Nos. D315,056, D322,720 and D335,217.

In U.S. Pat. No. 3,604,231 an elastic body loop is disclosed having a plurality of engagement secondary loops thereon from which a key engagement ring can be selectively positioned.

Design U.S. Pat. Nos. 335,217 and 315,057 disclose an ornamental design for a bracelet like key rings having fabric bands with fastening means on its respective ends so as to be removably secured on a person's wrist with a key engagement loop extending therefrom.

Design U.S. Pat. No. 322,720 discloses an ornamental design for a key fob having a generally flat oval shape fob element from which extends a pair of oppositely disposed attachment straps with hook and loop fasteners thereon. A key engagement ring extends through the apertures in the fob portion providing a key engagement element.

SUMMARY OF THE INVENTION

A universally engageable key ring assembly for converting individual items into key rings by adhesively securing an engagement ring thereto. The key ring assembly provides for the use of different shapes and size items to be secured with a key engagement fitting that can be positioned at any point about the secured item by applying a self-adhesive non-resilient attachment band about the selected items.

DESCRIPTION OF THE PREFERRED EMBODIMENT

Figure 1:
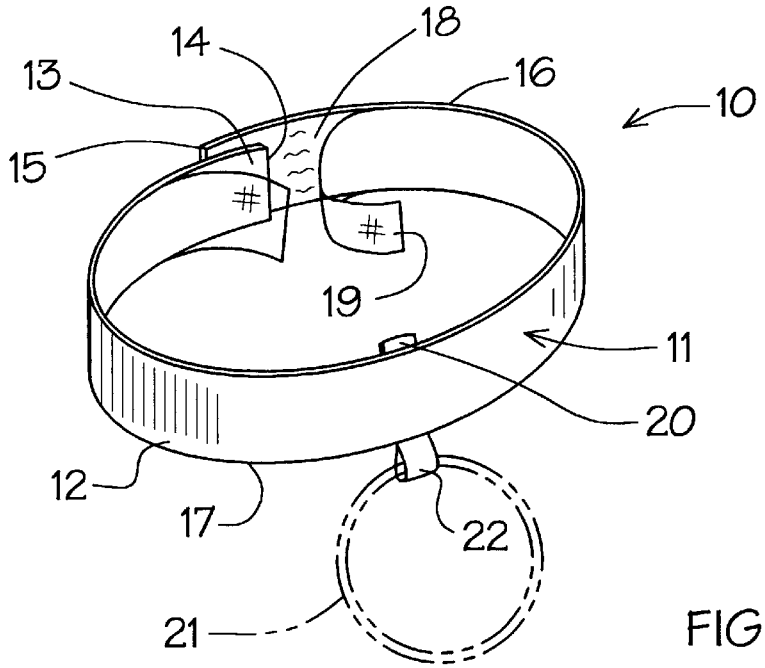
FIG. 1 is a perspective view of the key ring assembly of the invention.

Referring now to FIGS. 1–4 of the drawings, a key ring assembly 10 can be seen having an elongated rectangularly shaped band 11 of non-elastic material. The band 11 is of a cross-sectionally flat configuration defining an outer surface 12 and an inner surface 13 with oppositely disposed ends 14 and 15. The band 11 has a top edge portion 16 and a bottom edge portion 17 as will be understood by those skilled in the art.

Figure 2:
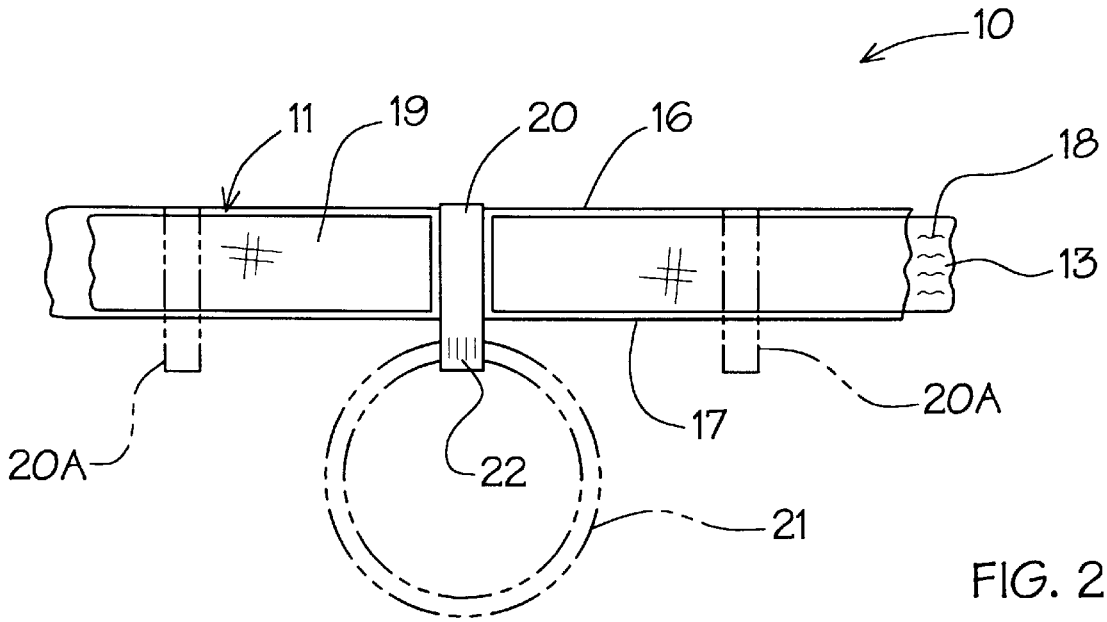
FIG. 2 is a partial front elevational view of the key ring assembly with alternate attachment elements positions and a key engagement ring shown in broken lines.
Figure 3:
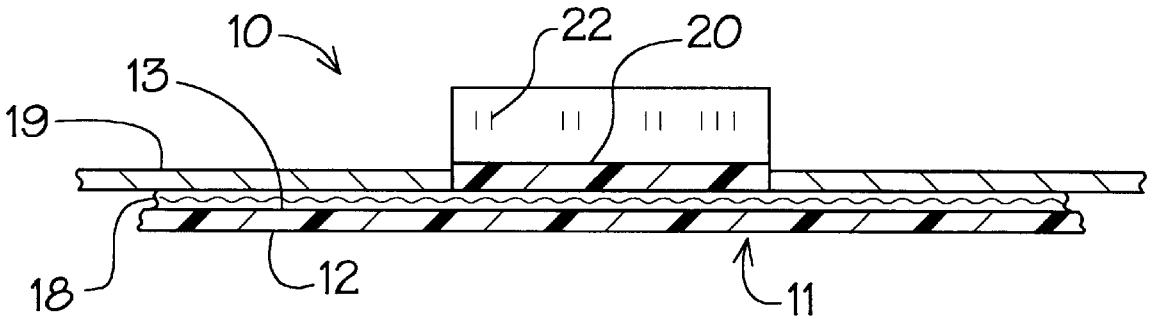
FIG. 3 is an enlarged partial cross-sectional view of the key ring assembly.

The band 11 is preferably made of a synthetic resin material, although it can also be made from any non-elastic flexible material being well suited for the environment on which use is required. An adhesive coating 18 is on the inner surface 13 of the band 11 and is of a pressure sensitive nature with a disposable release sheet 19 positioned thereover as best seen in FIGS. 2, 3 and 4 of the drawings.

Figure 5:
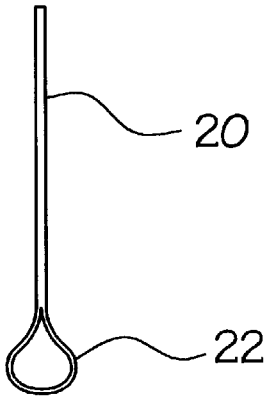
FIG. 5 is a side elevational view of the attachment element shown in FIG. 4.
Figure 6:
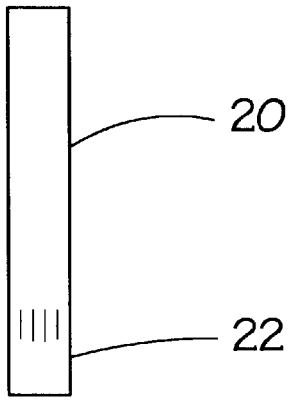
FIG. 6 is a front elevational view of the attachment element shown in FIG. 4.
Figure 4:
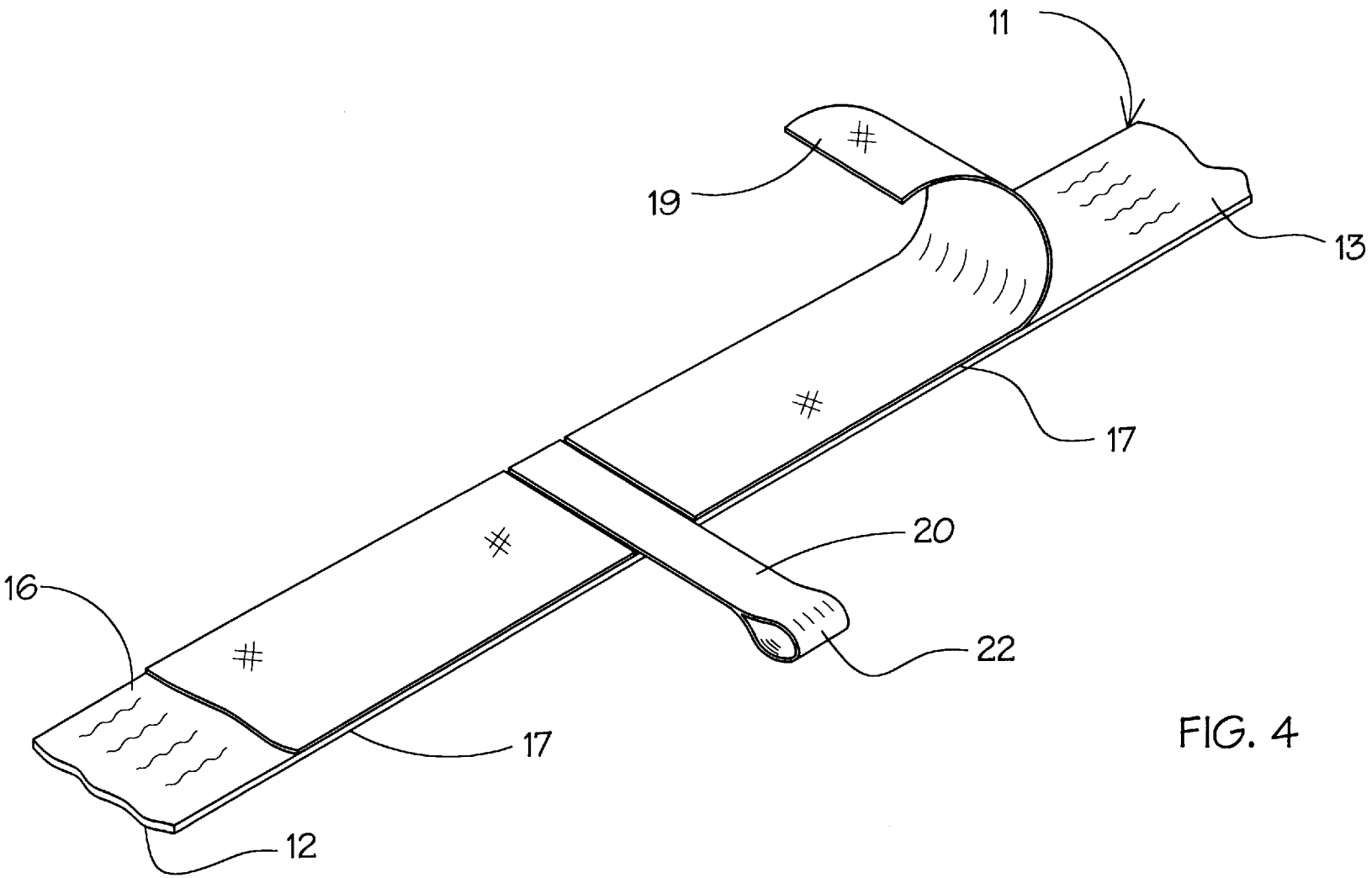
FIG. 4 is a partial perspective view of the key ring assembly with attachment elements secured thereto.

Referring now to FIGS. 4, 5 and 6 of the drawings, a key attachment element 20 can be seen having a main body member 21 with a loop opening at 22 formed on one end thereof. The attachment element 20 is preferably formed of a molded one-piece thin synthetic resin material having a length greater than its width so as to be secured to the inner surface 13 by the adhesive coating 18 on the band 11. The attachment element 20 is of a length greater than the transverse dimension of the band 11 so as to extend therebeyond once aligned placement thereto as best seen in FIG. 4 of the drawings.

In the example chosen for illustration, the attachment element 20 is positioned midway from the respective band ends 14 and 15 and extends generally from the top edge portion 16 and beyond the bottom edge portion 17 of the band 11. In the preferred embodiment, the release sheet 19 is divided on either side of the attachment element 20 thereof. This allows for the pre-positioning of the attachment element 20 during the manufacture while in an alternate configuration it will be seen that an attachment element 20A can be selectively positioned anywhere along the inner surface 13 of the band 11 by the end user giving maximum flexibility to the key ring assembly 10 of the invention as illustrated in broken lines in FIG. 2 of the drawings.

Referring back to FIG. 3 of the drawings, an enlarged partial cross-sectional view of the pre-attachment position for the attachment element 20 can be seen wherein relative dimensional characteristics of the band 11, adhesive coating 18 on the inner surface 13, release sheet 19 and integrally attachment element 20 can be seen. A key receiving ring element 21 is shown in broken lines extending through the loop end 22 of the attachment element 20 in FIGS. 1 and 2 of the drawings onto which keys (not shown) can be removably positioned as is well known and understood by those skilled in the art.

Figure 7:
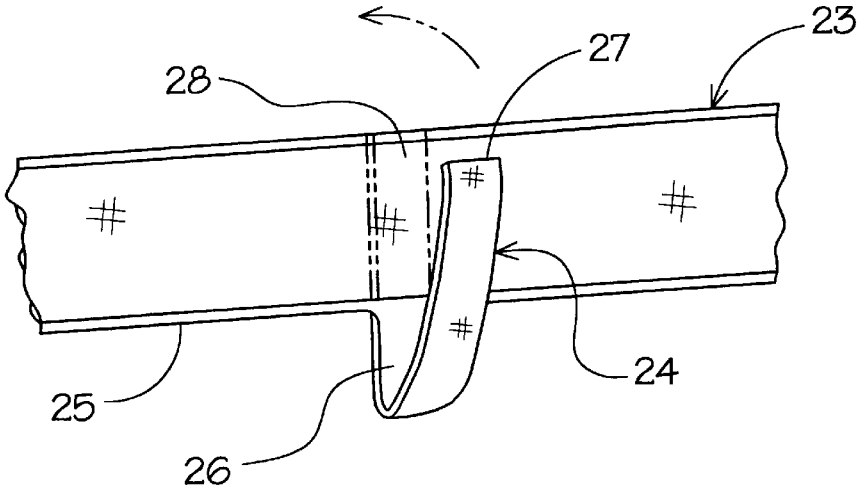
FIG. 7 is an enlarged front elevational view of an alternate form of the invention with portions broken away.
Figure 8:
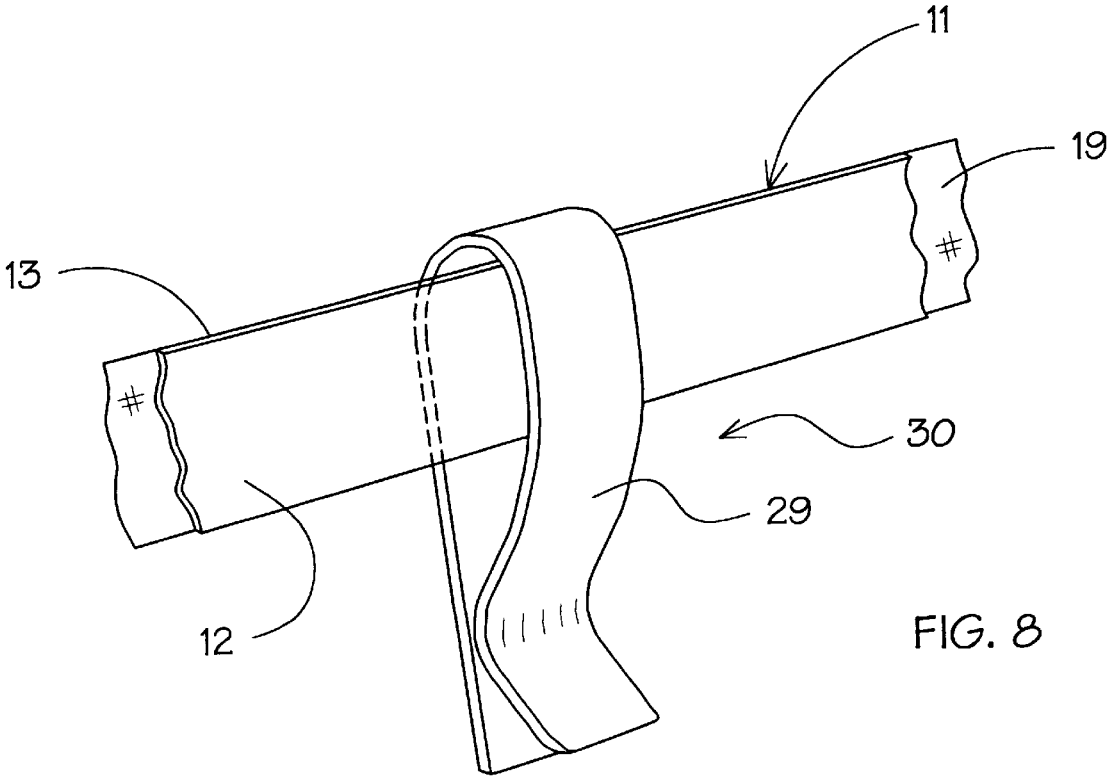
FIG. 8 is an enlarged partial perspective view of a second alternate form of the invention illustrating a belt clip secured to the key ring assembly of the invention.

Referring now to FIGS. 7 and 8 of the drawings, alternate forms of the invention can be seen wherein in FIG. 7 an alternate attachment band 23 is illustrated wherein the alternate attachment element 24 is formed from an integral extension of the band extending outwardly at right angles thereto. The attachment element 24 extends from a bottom edge portion 25 and is of an overall length greater than the transverse dimension of the alternate band 22. This allows for an attachment loop 26 to be formed by attaching the alternate attachment element 24 inwardly from its distal end at 27 onto an inner adhesive surface 28 shown in broken lines in FIG. 7 of the drawings.

A third alternate attachment element can be seen in FIG. 8 of the drawings wherein a resilient belt clip 29 can be secured to the adhesive coating 18 on the inner surface 13 of the band 11 of the preferred embodiment providing a clip attachment device 30. In this form of the invention the dimensional thickness of the band 11 may vary incrementally to impart additional stability to the resilient belt clip 29.

It will be noted that all of the forms of the invention in the accompanying drawing and description and detailed herein have in common the basic structure set forth in the preferred form in that of the thin flexible band 11 having adhesively coated inner surface 13 with an overlying release sheet 19 and attachment element 20 adhesively secured to the inner surface 13 between the band 11 and an engagement article (not shown) on which the band is to be positioned.

It will be evident to those skilled in the art that various changes and modifications may be made therein without departing from the spirit of the invention.

Therefore I claim:

1. A key ring assembly comprising an elongated thin flat flexible band, said band having an inner engagement surface, an outer engagement surface, and oppositely disposed terminus ends, pressure sensitive adhesive coating covering the entire said inner engagement surface, a release sheet extending over the band's inner surface, an attachment element extending transversely across and is affixed to a portion of said inner engagement surface, said attachment element is of an overall length greater than that of the band's width having a band engagement portion and a loop end portion, a key ring removably positioned through said loop end portion.

2. The key ring assembly set forth in claim 1 wherein said band is of a thin flat flexible material.

3. The key ring assembly set forth in claim 1 wherein said elongated flexible band is cross-sectionally flat and preferable made of synthetic resin material.

4. The key ring assembly set forth in claim 1 wherein said release sheet on said inter-engagement surface extends from said attachment element to said respective oppositely disposed terminus ends thereof.

5. A key ring assembly comprising an elongated flexible band, said band having an inner engagement surface and opposing ends, said entire inner engagement surface has a pressure sensitive adhesive coating thereon, an elongated integral attachment element extending from a bottom edge of said band said attachment element has a band engaging portion and a loop portion, a key ring removably positioned through said loop portion.

6. The key ring assembly set forth in claim 5 wherein said inner engagement attachment element is of a known length greater than that of the transverse dimension of said band.

7. The key ring assembly set forth in claim 5 wherein said integral elongated attachment element is cross-sectionally flat.

* * * * *